United States Patent [19]

Ernst et al.

[11] 4,125,207

[45] Nov. 14, 1978

[54] CHAIN SAW SERVICING KIT

[75] Inventors: Frederick T. Ernst, Thorndike Pond Rd., Jaffrey, N.H. 03452; Frank Klay, Hingham, Mass.

[73] Assignee: Frederick T. Ernst, Jaffrey, N.H.

[21] Appl. No.: 772,543

[22] Filed: Feb. 28, 1977

[51] Int. Cl.[2] ..... B67D 3/00; B65D 25/46; B65D 21/02

[52] U.S. Cl. ..... 222/130; 215/1 C; 215/6; 220/20; 220/23.4; 220/85 SP; 220/94 A; 222/475; 222/530; 222/533; 222/538

[58] Field of Search ..... 220/20, 23.4, 23.6, 220/23.8, 85 SP, 94 A; 215/1 C, 6, 10; 150/0.5; 222/130, 143, 475, 527, 530, 533, 534, 538, 566

[56] References Cited

U.S. PATENT DOCUMENTS

| | | | |
|---|---|---|---|
| 1,558,985 | 10/1925 | Howell | 222/534 |
| 1,600,379 | 9/1926 | Werneman | 222/538 |
| 2,661,678 | 12/1953 | Freeman | 222/143 |
| 3,154,219 | 10/1964 | Dean | 220/20 |
| 3,199,739 | 10/1965 | Corning | 222/130 |
| 3,269,389 | 8/1966 | Meuer | 215/6 |
| 3,441,071 | 8/1969 | Schurman | 150/0.5 |
| 3,834,437 | 9/1974 | Swett | 150/0.5 |
| 3,872,900 | 3/1975 | Gutz | 220/86 R |
| 3,966,076 | 6/1976 | Kruger | 220/94 A |
| 3,999,661 | 12/1976 | Jones | 150/0.5 |

FOREIGN PATENT DOCUMENTS

| | | | |
|---|---|---|---|
| 5,478 of | 1927 | Australia | 222/143 |
| 520,423 | 6/1953 | Belgium | 220/85 SP |
| 1,160,782 | 1/1964 | Fed. Rep. of Germany | 222/130 |
| 654,579 | 8/1963 | Italy | 150/0.5 |
| 6,860 of | 1896 | United Kingdom | 220/85 SP |

*Primary Examiner*—George E. Lowrance
*Attorney, Agent, or Firm*—Dike, Bronstein, Roberts, Cushman & Pfund

[57] ABSTRACT

A servicing kit for chain saws comprising nested compartments which collectively have an external symmetry with respect to the longitudinal bisector of the structure, said compartments having interior walls, one of which projects into the interior wall of the other to an extent such that the ratio of the volumes of the compartments to each other is approximately two-to-one, a compartment included between the interior walls constituted by a diagonal depression in one of the walls which terminates short of the bottom and is open at the top and a carrying handle at the top. There are filling openings at the tops of the respective compartments located symmetrically with respect to the longitudinal bisector at opposite sides of the handle and pouring spouts pivotally mounted to the filling openings for pivotal movement from positions substantially parallel to the handle to positions extending beyond one end and said handle contains along its opposite sides recesses for receiving the pouring spouts when folded into parallel relation thereto. There are also supports for retaining the pouring spouts in their folded positions and these supports contain vent openings in communication with the respective compartments.

8 Claims, 6 Drawing Figures

CHAIN SAW SERVICING KIT

BACKGROUND OF INVENTION

A chain saw is powered by a two-cycle engine which burns a combination of gasoline and oil known as the fuel mix and requires, in addition to the fuel mix, an adhesive-type oil formulated especially for lubrication of the guide bar and cutting chain known as chain oil. The consumption of fuel mix and chain oil proceeds at an approximate ratio of two parts of fuel mix to one part of chain oil. Ordinarily, the chain saw operator brings the two separate liquids to the work site in one-gallon plastic jugs and has to refill the machine at intervals as often as 20 minutes. In addition to the inconvenience of toting the two jugs in one hand and the saw in the other, the operator must unscrew the two caps of the one-gallon plastic jugs and, in some cases, screw pouring nozzles to replace the caps.

For reasons of design compactness, many chain saw tank openings are quite small in diameter and so positioned as to make the act of pouring from a short-necked ventless jug very awkward. Because of the external appurtenances (the bar and the handle) or simply because of the forward contour of the saw case), it is usually necessary to hold the jug an inch or two above the tank openings while pouring. This results in spills which, especially in the case of the oil, causes a considerable mess for the saw, hands, and, inevitably, clothing.

When the tanks of the saw are replenished, it is, of course, necessary to replace the two jug caps which were previously set aside and, often, much time is spent searching for them among the leaves and, not infrequently, one is lost. If lost, there follows the likely prospect of spillage from a tip-over either in the woods or in the car on the way to the base of operation, in which event, a genuine safety hazard is added to the inconvenience.

In addition to the above, it frequently happens that the saw requires services such as the increasing of chain tension, the clearing of a fouled spark plug, the adjustment of a carburetor jet, or the sharpening of the chain cutters, which become dull through normal usage as well as by inadvertently striking offensive material such as stone or earth. These rudimentary servicing operations require the presence of two or three tools such as a file, combination T-wrench, or their equivalents, which cannot be carried on the saw itself or, without some discomfort and restriction, on the person of the operator. As a result, these necessary items are often left behind, thus causing a trip back to the operator's home or vehicle and the possibility of a considerable interruption to the work in progress.

It is the principal object of this invention to provide a multipurpose kit for a saw operator which will enable him to transport the fuel mix, chain oil and a few basic tools to the work site which, by reason of its design, will not only enable carrying the fuel and chain oil in the proper proportion, but will make it possible to easily and quickly replenish the fuel mix and chain oil without loss of time, without having to carry a number of containers and pocket tools, and without the possibility of spillage and/or the safety hazard of uncovered fuel containers.

SUMMARY OF INVENTION

As herein illustrated, the kit comprises two separate containers arranged to have an external symmetry with respect to a line bisecting the structure longitudinally and nested interior walls of concave and convex configuration such that the ratio of the volume of the two separate containers is two-to-one. There is a handle at the top of the structure which coincides with the longitudinal bisector and filling openings at the top located symmetrically with respect to the bisector at opposite sides of the handle to which pouring spouts are pivotally mounted for pivotal movement from positions substantially parallel to the handle to positions extending beyond one end. The handle contains along its opposite sides recesses for receiving the spouts when folded into parallel relation. At the interfaces of the nested containers, there is in the convex wall a diagonal depression of such depth as to be symmetrical with respect to the longitudinal bisector which defines a third compartment closed at its lower end and open at its top. There are supports on the handle so positioned as to be engaged by the ends of the spouts when the latter are arranged parallel to the handle to frictionally retain the spouts in said position and vent openings in the supports. The spouts have ventral stops on their undersides to prevent too far penetration of the spouts into the orifices through which the content of the containers are to be dispensed. The two compartments are hinged along a common side to be folded on the hinge to positions of engagement in which the two of the sides of the respective compartments are in engagement, each being provided with handle means along the opposite side so that when the compartments are folded, the handles at the opposite sides collectively define a carrying handle for the kit and there is means for securing the compartments in engagement.

The invention will now be described in greater detail with references to the accompanying drawings, in which.

Figure 2:
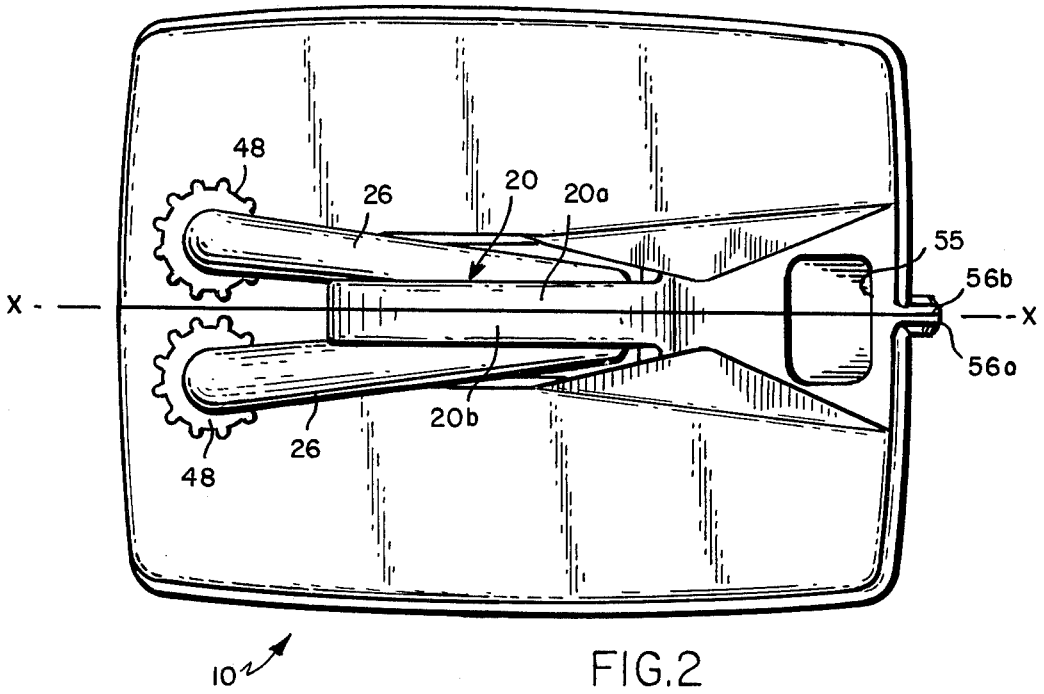
FIG. 2 is a plan view of FIG. 1.

Referring to the drawings, the kit as herein illustrated comprises a composite structure 10 of generally rectangular exterior configuration in both horizontal and vertical planes having top, bottom, end and side walls which are symmetrical with respect to a line X—X drawn longitudinally of the structure as shown in FIG. 2.

Figure 1:
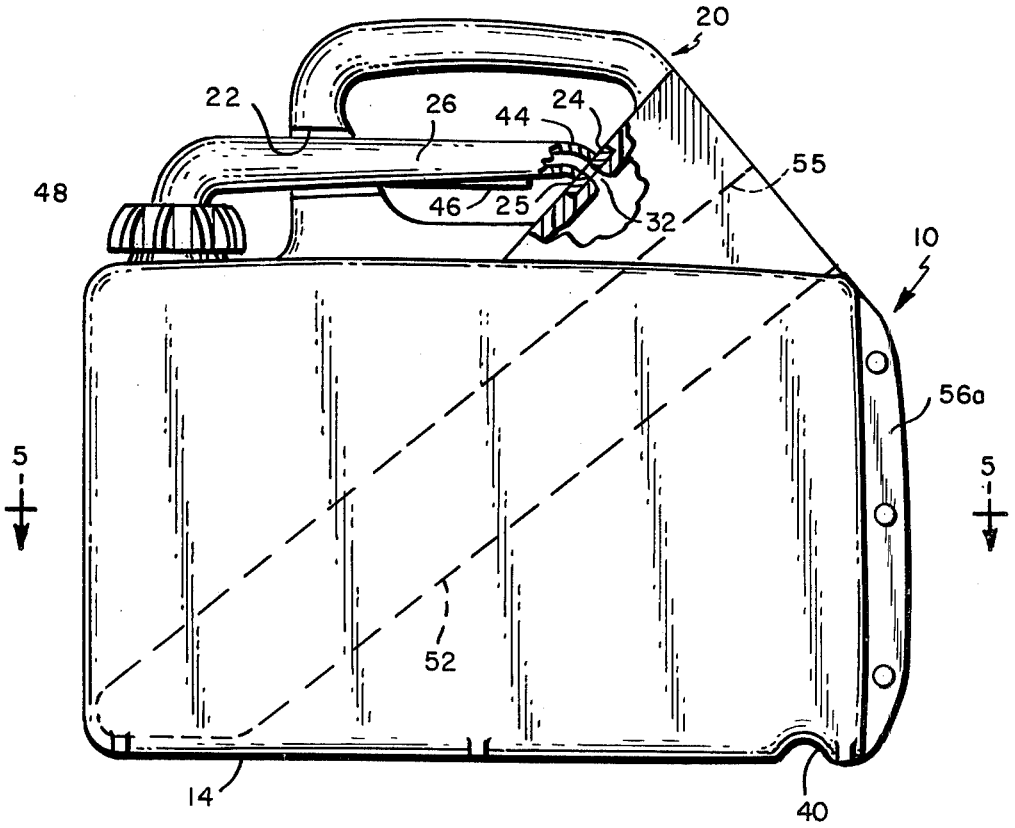
FIG. 1 is an elevation as seen from one side with a portion in section.
Figure 3:
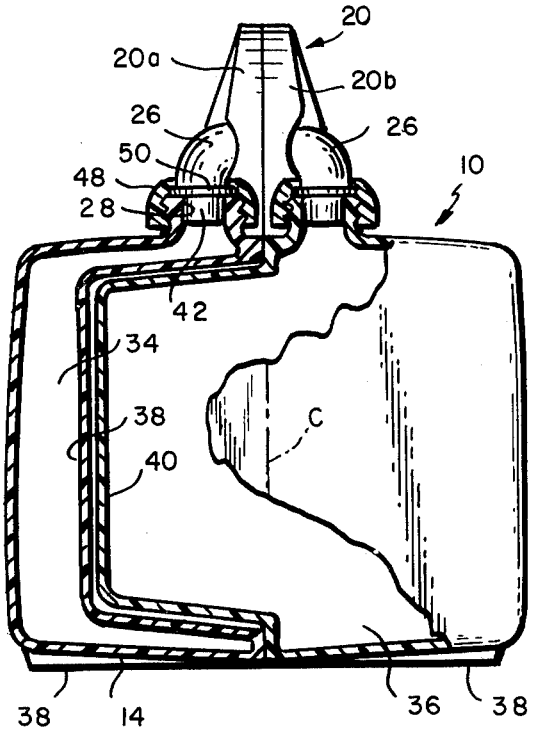
FIG. 3 is an elevation as seen from the left end of FIG. 1 with portions in section.
Figure 4:
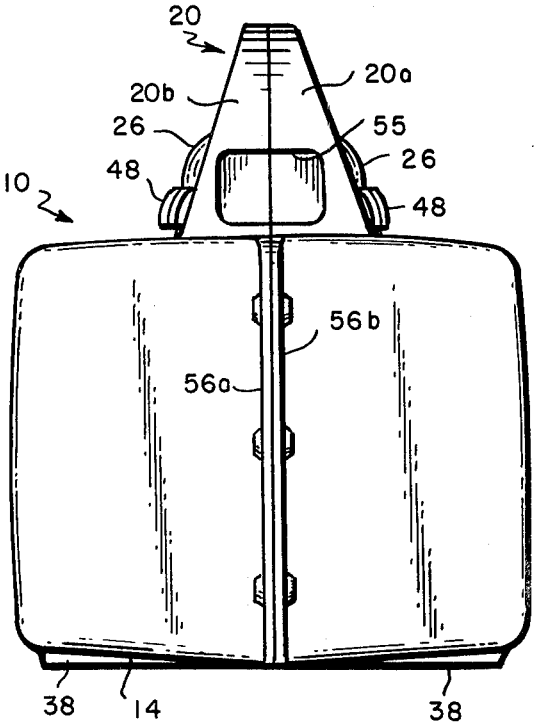
FIG. 4 is an elevation as seen from the right end of FIG. 1.
Figure 5:
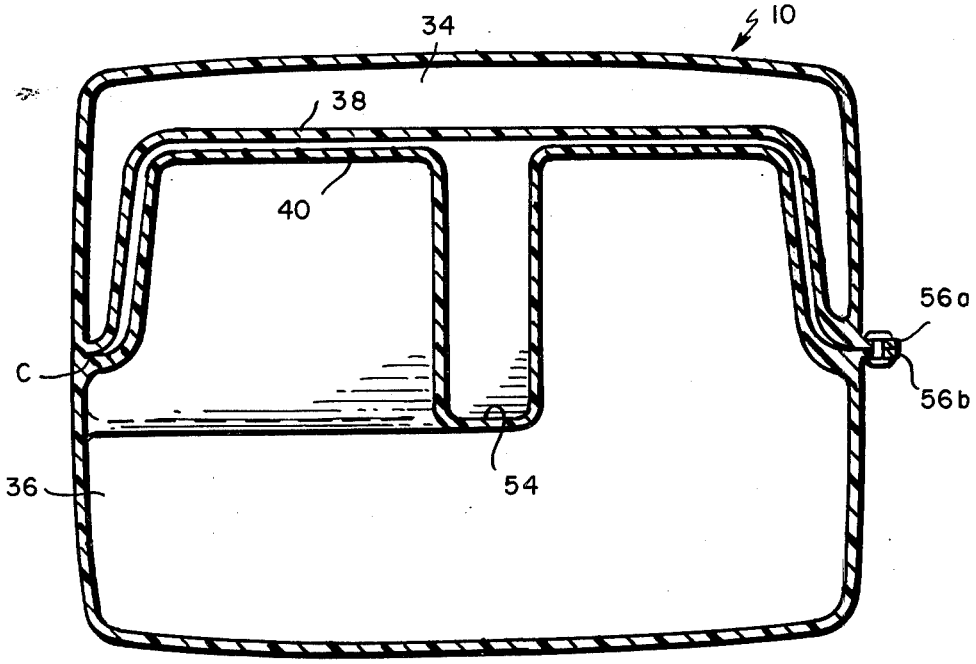
FIG. 5 is a horizontal section taken on the line 5—5 of FIG. 1.

At the top of the structure and coinciding with the longitudinal bisector X—X, there is a carrying handle 20 which stands perpendicular to the top and which contains in its opposite sides half-circular recesses 22-22 and at one end inclined supports 24-24 for receiving the distal end of a pair of nozzles 26-26, the proximal ends of which are pivotally mounted to filling openings 28-28 located at the left end of the structure as shown in FIGS. 1 and 2 at opposite sides of the longitudinal bisector. The upwardly facing sides of the supports 24-24 are surfaced with neoprene sealing gaskets 25-25 that seal the distal ends of the nozzles when folded, thus preventing leakage from the ends of the nozzles and from vent holes 32-32 at the top of the compartments. An outside diameter at the tip of the nozzle of $\frac{5}{8}$ inches is required to insure servicing most chain saws.

The interior of the structure is divided into two completely independent compartments or chambers 34,36 by a pair of complementary nesting interior walls 38 and 40, the wall 38 comprising the inner side of the chamber 34 and being concavely recessed and the wall 40 comprising the inner side of the chamber 36 being convexly protruding into the concavely recessed wall 38. The division is designed to provide for a ratio of approximately two-to-one, that is, the chamber 36 will hold approximately twice the volume of the chamber 34. The filling openings 28-28 are in communication, respectively, with the chamber 34 and the chamber 36.

The bottom 14 of the structure is provided with transversely extending longitudinally spaced footing ribs 38 and at the rear end with respect to the filling openings which are at the forward end, an upwardly concave groove 40 which provides a rest for steadying the structure when tilting it for pouring.

Each nozzle 26 comprises an elongate hollow structure having at one end a swivel sleeve 42 telescopically engageable within the filling opening 28 and rotatable therein and at its other end a pouring lip 44. At the underside of the nozzle, there is a stop 46 which limits penetration of the lip of the spout within the tanks of the chain saw to be filled. The spouts are pivotally secured to the filling openings by threaded caps 48 which are screwed onto the threaded exteriors of the filling openings over a retaining flange 50 at the junction of the proximal end of the nozzle with the swivel sleeve 42. When pivotally mounted, the nozzles may be moved through approximately 180° from positions in which they are parallel to the handle, as shown in FIG. 1 to positions beyond the left end of the structure. The swivels are sufficiently snug so that the distal ends of the nozzles are depressed somewhat lower than the surface of the supports 24-24 and, hence, must be stressed upwardly to be engaged with the supports. This assists in holding the nozzles in their folded position and maintaining a seal with the gaskets on the supports. In order to facilitate pouring, the nozzles are made of translucent plastic.

The structure as thus far described embodies two separate and independent chambers for holding, respectively, the fuel mix and the chain oil. There is, in addition, a third chamber 52 which is formed at the interfaces of the inner walls 38 and 40 within the convexly extending wall 40 in the form of a depression 54 in that wall which extends diagonally from the lower left-hand corner of the structure upwardly through the top near the right-hand top corner, the depression defining with the wall 38 an inclined pocket contained within the structure of such size as to easily receive one or more tools such as files, an open end wrench, and the like. The depression is deep enough so that the opening 55 at the top is located substantially symmetrically with respect to the longitudinal bisector X—X.

In order to prevent the tools from accidentally falling out during tip-over or other dislodging motion, a piece of wadding such as a piece of artificial turf may be thrust into the open end of the opening 55 to wedge the tool in place.

Figure 6:
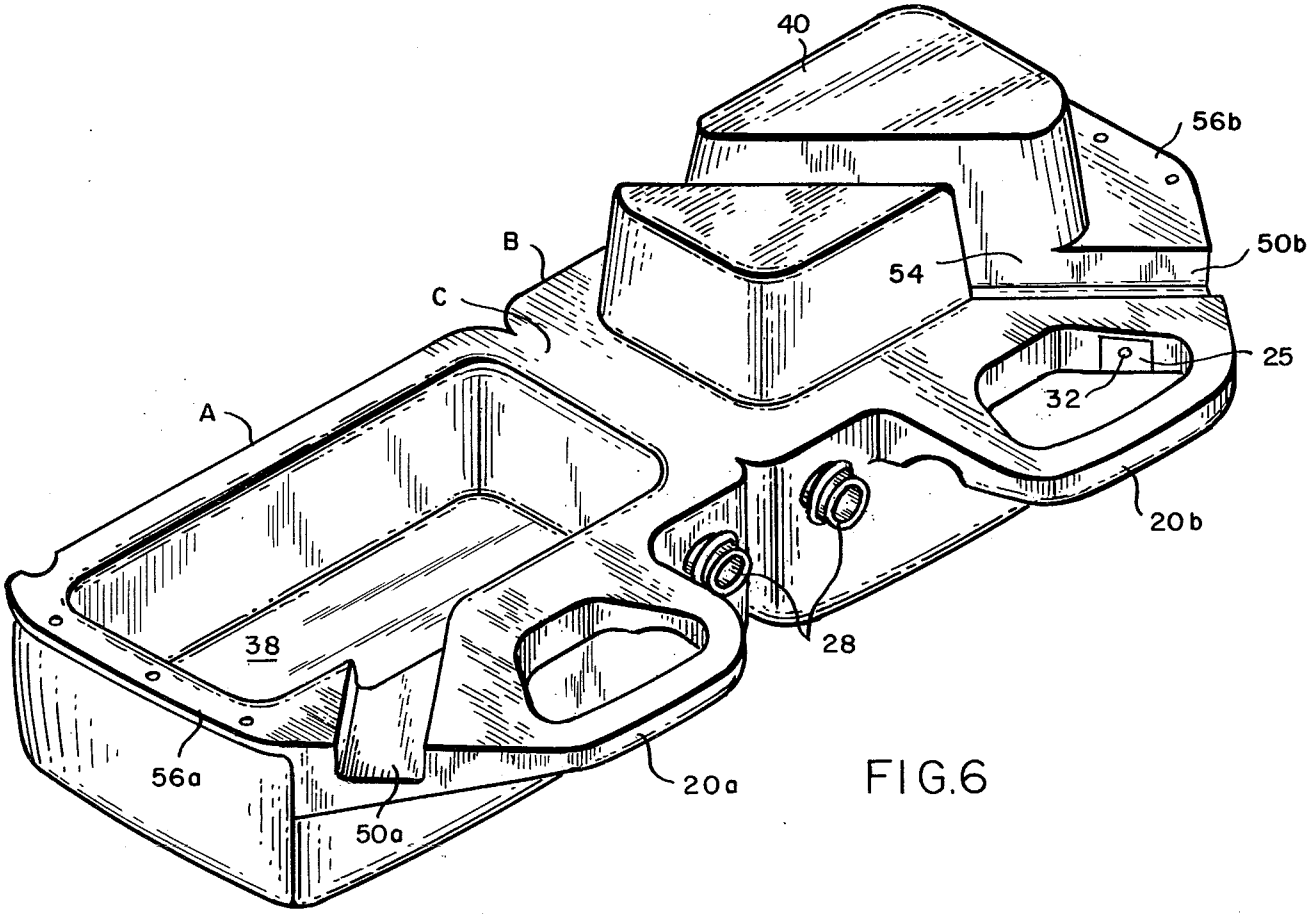
FIG. 6 is an isometric of the kit as manufactured by a blow-molding process prior to folding of the compartments into engagement and securing them to form the structure shown in FIGS. 1, 2, 3 and 4.

The structure as thus described is made by a process of blow-molding in two parts A and B, FIG. 6, hingedly connected along the line C. The part A embodies the inner wall 38 which is recessed with respect to the inner side, one of the threaded openings 28, an opening **50*a* which comprises one-half of the open end 55 of the pocket, one half 20*a* of the handle and a flange 56*a*. The part B embodies the convexly protruding wall 40, the other half 20*b* of the handle, the other filling opening 28, the depression 54, the other half 50*b* of the open end 55 of the pocket and a flange 56*b*. The two parts A and B are folded upon each other and secured by fastening elements inserted through the flanges 56*a*–56*b***.

The kit is preferably comprised of molded plastic. However, it may also be fabricated of sheet metal.

The structure can be made quite easily with conventional blow-molding techniques and thus provides an inexpensive and yet very durable carrier which meets most of the needs of a saw operator on the job.

It should be understood that the present disclosure is for the purpose of illustration only and includes all modifications or improvements which fall within the scope of the appended claims.

I claim:

1. A container for transporting in separate compartments of different volume different materials comprising two entirely complete receptacles, each having outer side walls of identical configuration and inner side walls comprising planar portions adapted to be juxtaposed to provide a composite structure which is symmetrical with respect to the plane of said planar portions and within the planar portions an inner recessed wall and an inner protruding wall of such configuration that when the receptacles are juxtaposed, the protruding inner wall extends into the recessed inner wall, said outer wall of the two receptacles at the top containing filling openings adjacent one end situated symmetrically with respect to the plane of the planar portions of the receptacles, spouts pivotally connected at one end to said filling openings and half-handles integrally formed to the outer walls at the top intermediate the ends of the outer walls having planar surfaces situated in the planes of the planar surfaces of the inner walls adapted to meet in the plane of the planar surfaces of the inner walls to collectively define a whole handle and means for securing the two receptacles in juxtaposed relation, said spouts being pivotally movable from positions extending laterally from the container to positions parallel to the handle and said handle containing recesses for receiving and confining the distal ends of the spouts in a stored position at opposite sides of the handle.

2. A container according to claim 1 wherein at the interfaces of said inner walls there is a diagonal depression, the upper end of which emerges through the top of the composite structure and is symmetrical with respect to said planar surfaces.

3. A container according to claim 1 wherein there are support surfaces on the half-handles positioned to become engaged by the ends of the spouts when the latter are folded into parallel relation to the handle to frictionally retain the spouts in said positions.

4. A container according to claim 3 wherein said support surfaces contains vent openings in communcation with the receptacles.

5. A container according to claim 1 wherein there is hinge means joining the two receptacles.

6. A container according to claim 1 wherein said spouts are comprised of translucent material.

7. A container according to claim 1 comprising means for closing the distal ends of the spouts when they are folded parallel to the handle and to open them when they are removed from said folded position.

8. A container according to claim 1 wherein the spouts have ventral stops on their undersides to prevent too far penetration of the spouts into the filling openings through which the contents of the containers are to be dispensed.

* * * * *